United States Patent [19]

Tracy

[11] 4,235,073

[45] Nov. 25, 1980

[54] CHAIN BREAKER

[75] Inventor: Wayne R. Tracy, Chicopee, Mass.

[73] Assignee: Incom International Inc., Pittsburgh, Pa.

[21] Appl. No.: 966,305

[22] Filed: Dec. 4, 1978

[51] Int. Cl.[3] ..... B21L 5/00

[52] U.S. Cl. ..... 59/11; 29/268; 81/418

[58] Field of Search ..... 29/268, 267; 72/409; 59/7, 11; 81/303-307, 418; 420, 422, 424

[56] References Cited

U.S. PATENT DOCUMENTS

| | | | |
|---|---|---|---|
| 1,321,452 | 11/1919 | Ivory | 30/364 |
| 3,063,236 | 11/1962 | Cannon | 29/268 |
| 3,698,181 | 10/1972 | Paul et al. | 59/11 |

FOREIGN PATENT DOCUMENTS

| | | | |
|---|---|---|---|
| 188297 | 8/1960 | Sweden | 29/268 |

*Primary Examiner*—James L. Jones, Jr.

*Attorney, Agent, or Firm*—James Creighton Wray

[57] ABSTRACT

A chain breaker has an interchangeable turret anvil plate mounted on an upper surface of a lower jaw. The lower jaw has a slotted upper portion which extends partially over the anvil plate. An upper jaw has a reduced lower portion which fits within the slotted upper portion of the lower jaw. A retainer pin extends through the slotted portion and holds the jaws together. Near the pin a retaining portion of the upper jaw extends over the anvil plate and the threaded retainer and prevents accidental dislodgement of the anvil plate and threaded retainer. An outer surface of the retaining portion abuts a chain workpiece. A pin connects two handles on a line with the jaw pivot pin, and pins connect individual handles and the jaws on a line which intersects the first line close to the handle pin. A forcer screw in an outer end of the upper jaw carries a breaker tip at its lower end which is positioned just above a cantilevered portion of the anvil plate.

14 Claims, 7 Drawing Figures

FIG. 1
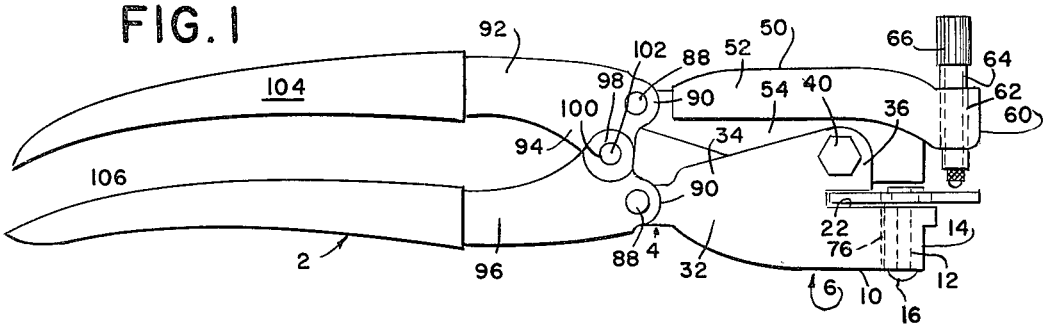
FIG. 2
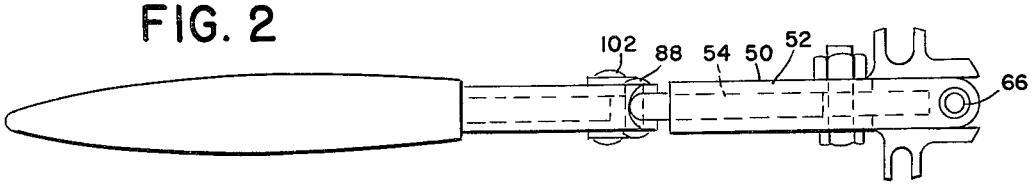
FIG. 3
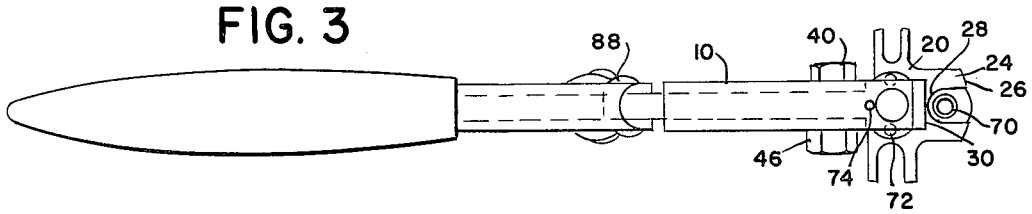
FIG. 4
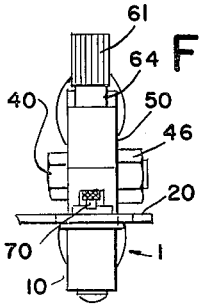
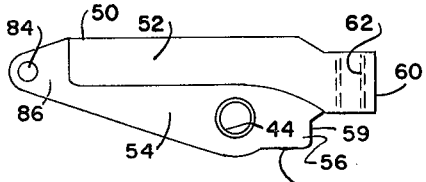
FIG. 5
FIG. 6
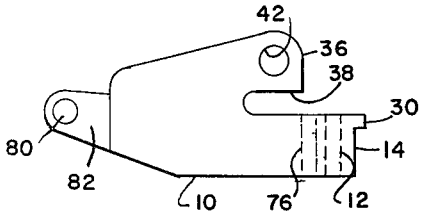
FIG. 7
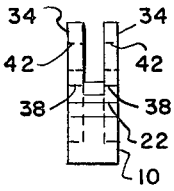

CHAIN BREAKER

SUMMARY OF THE INVENTION

Hand tools for disconnecting chain links are shown for example in U.S. Pat. No. 3,698,181.

The chain breaker of the present invention has two handles with jaw connections at proximal ends. Near the proximal ends the handles are overlapped and holes formed to receive a handle pin slightly inward from the proximal end. The proximal ends of the handles are connected to distal ends of upper and lower jaws. The jaws are connected near their proximal ends by a jaw pivot pin which extends through an upper portion of the lower jaw and a lower portion of the upper jaw. The upper portion of the lower jaw extends over a surface which receives an anvil plate and tends to retain the plate against accidental dislodgement from the surface. Preferably, the upper portion of the lower jaw is bifurcated and the forward section of this bifurcated portion extends over the anvil plate.

The proximal end of the lower jaw has a vertical bore for receiving a threaded member which holds the anvil plate on the surface. In a preferred embodiment, a portion of the anvil plate projects outward over the proximal end of the lower jaw. A threaded member which holds the anvil plate on the lower jaw extends upward above the anvil plate for easy removal and changing of the anvil plate. A plunger is fitted within a bore inward of the previously described bore. An elongated spring loaded plunger is urged upward into contacts with detent openings in the anvil plate which is formed as a turntable turret. The plunger is retained in the secondary plunger bore when the threaded member is removed from the first bore and the turret anvil plates are being interchanged.

The lower portion of the upper jaw fits within the bifurcated portion of the lower jaw and extends forward therefrom to form a retaining portion which overlies the anvil plate and the threaded insert which holds the plate on the surface of the lower jaw. This forward extending retainer portion tends to prevent accidental dislodgement of the threaded portion and anvil plate when the jaws are closed in use.

A forward end of the retaining portion has an outer surface which prevents inward movement of a workpiece in the direction of the handles.

The upper jaw has an upper relatively thick portion along its crown which terminates outwardly in a proximal end having a vertical bore for receiving a forcer screw. The bore is tapped and the screw is threaded to permit vertical adjustment.

The lower end of the forcer screw is recessed to receive a hardened breaker tip insert which is aligned with the cantilevered portion of the anvil plate. In preferred embodiments, the handle pivot pin and the jaw pivot pin are aligned on a generally horizontal line. The handle-jaw connections are aligned on a generally vertical line which perpendicularly intersects the horizontal line near the handle pin. The intersection of the two lines is preferably from 8 to 12 percent of the distance from the handle pivot pin to the jaw pivot pin. The forcer screw and breaker tip are aligned on the vertical line at a distance from the jaw pivot pin which is approximately half the distance between the jaw and handle pivot pins.

A reasonable squeezing effort on the handles produces a force greater than one ton at the breaker tip.

A chain breaker has first and second jaws, a pivot pin in an opening near an upper extremity of the first jaw and near a lower extremity of the second jaw. A vertical bore in an outward projecting lower extremity holds a threaded screw. The second jaw has an outer extremity with a second vertical threaded bore, aligned parallel to the first vertical threaded bore and displaced outwardly therefrom. A threaded forcer screw is engaged in threads of the second bore and extends downward therefrom. A breaker tip is inserted in a lower end of the forcer screw. An anvil plate is positioned on the upward facing surface above the bore in the first jaw and extends outward therefrom below the breaker tip. The pivot pin is positioned over the anvil plate.

An upper portion of the first jaw is centrally, slotted and a lower portion of the second jaw is reduced in size compared with an upper portion of the second jaw, whereby the lower portion of the second jaw fits within the central upper slot of the first jaw.

In a preferred form the anvil plate is a turret, turnable about a threaded insert and the pivot pin extends over the anvil turret for retaining the anvil turret.

Preferably the second jaw has a retaining portion extending between the pivot pin and the forcer screw which overlies the anvil plate and retains the anvil plate against accidental dislodgement. In a preferred form the retaining portion overlies the threaded insert for retaining the threaded insert and the anvil plate against accidental dislodging.

The retaining portion has an outer surface spaced slightly inward from the forcer screw and the breaker tip, which outer surface prevents movement of workpiece parts in a direction toward the pivot pin and toward a person using the tool.

The threaded insert extends above the anvil plate, and when the jaws are opened, the threaded insert may be turned out of the first bore, releasing the anvil plate for replacement by a different anvil plate.

A plunger pin contacts recesses in the anvil plate to firmly position the anvil plate on the upper surface of the first jaw.

Handle connection means are substantially equidistant from the first pivot pin receiving openings. A handle pivot pin and the pivot pin in the jaws are generally aligned on a first line, and the first and second handle-jaw connectors are generally aligned on a second line perpendicularly intersecting the first line near the handle pin.

Preferably the second line intersects the first line at about 8 to 10 percent of the distance between the handle pin and the jaw pivot pin.

in a preferred form the forcer screw and the breaker tip are aligned perpendicular to an extension of the first line. Preferably the forcer screw and breaker tip are positioned approximately half as far from the jaw pivot pin as the distance between the jaw pivot pin and the handle pin.

These and other objects and features of the invention are apparent in the disclosure which includes the above and ongoing description and claims and the drawings.

BRIEF DESCRIPTION OF THE DRAWINGS

FIG. 1 is an elevation of a chain breaker of the present invention.

FIG. 2 is a top view of the chain breaker and FIG. 3 is a bottom view.

FIG. 4 is an end elevation of the chain breaker shown in FIG. 1.

FIG. 5 is a detail of the second, upper jaw.

FIG. 6 is a side elevation detail of the first lower jaw, and FIG. 7 is an end elevation of the lower jaw shown on FIG. 6.

DETAILED DESCRIPTION OF THE DRAWINGS

Referring to FIGS. 1 through 7, a chain breaker of the present invention is generally referred to by the numeral 1. The chain breaker has a handle 2 and a connection means 4 which connects the handle to a pair of jaws 6. The first lower jaw 10 has a vertical bore 12 near its proximal end 14. Bore 12 receives a screw 16. A threaded insert 18 cooperates with screw 16 to hold anvil turret 20 on a flat upper surface 22 of the lower jaw 10.

The anvil plate turret 20 has four sets of parallel cantilevering anvils 24. Each has a circular outer surface 26 and a semicircular inner surface 28. The entire anvil plate turret rests upon the flat upper surface 22 of the lower jaw 10 which is extended outward by a ledge 30 to support the anvil plate.

The lower jaw 10 has a lower solid portion 32 and an upper bifurcated portion 34. The upper portion has a forward extending portion 36 with a lower surface 38. Parallel lower surfaces 38 cooperate with the flat upper surface 22 to help to entrap the anvil plate turret 20. A plate pivot pin 40 extends through first aligned openings 42 in the lower jaw and second opening 44 in the upper jaw. Nut 46 completes the pin assembly.

Upper jaw 50 has a relatively thick upper portion 52 and a relatively thin lower portion 54 which fits between parallel walls 34 of the lower jaw. A forward extension 56 of the lower portion 54 has a flat lower surface 58 which overlies the anvil plate 20 and the threaded insert and acts as a retaining portion. An outer surface 59 is configured so that it is positioned near the workpiece.

A proximal end 60 of the upper portion of the upper jaw has a vertical threaded bore 62 which receives a forcer screw 64 having a knurled upper end 66. A lower end 68 of the forcer screw 64 is recessed to receive a breaker tip 70, which is centered in an opening of parallel anvils 24 of anvil plate 20.

Anvil plate 20 has lower recesses 72 which cooperate with a spring loaded plunger 74 in a small bore 76 in the lower jaw 10.

The connection means 4 is made up of hole 80 in relatively thin rearward extension 82 of the lower jaw and opening 84 in the thin rearward extension 86 of the upper jaw. Handle connection pins 88 are placed through the openings in the distal ends of the jaws and in the proximal ends 90 of the handles 2. Upper handle 92 has a downward extending portion 94 near its forward end, and lower handle 96 has parallel upward extension portions 98 which have openings 100 for receiving a handle connection pin 102. Handle connection pin 102 is approximately in horizontal alignment with jaw connection pin 40. The jaw-handle connection pins 88 are in vertical alignment on a line which perpendicularly crosses a line between the handle connection pin 102 and jaw connection pin 40 at a short distance from the handle connection pin 102. Soft hand grips 104 complete the handle 2.

As hand grips 104 are opened, pins 88 are pivoted inward and pin 102 is moved outward toward the distal end 106 of the handle. Jaws are opened, lifting the breaker tip 70 away from anvil plate 20.

As the handles are squeezed, pins 88 move outward, and pin 102 moves inward toward proximal ends 90 of the handles, and the breaker tip 70 is forced toward the anvil plate 20 with a force which exceeds one ton with reasonable squeezing of the hand grips.

In use, the jaws are opened and a link pin of the chain is placed within the selected parallel cantilevered anvils 24. Links are placed on top of anvil plate 20. The forcer screw is adjusted so that the breaker tip contacts one end of the link pin with the jaws slightly open and the handle open. The grips of the handle are squeezed together, forcing the breaker tip into the link pin and pushing the link pin through the links.

While the invention has been described with reference to a specific embodiment, it will be obvious to those skilled in the art that modifications and variations of the invention may be made without departing from the scope of the invention, which is defined in the following claims.

I claim:

1. Chain breaker apparatus comprising first and second jaws, the first jaw having a pivot pin receiving opening near an upper extremity thereof and the second jaw having a second pivot pin receiving opening near a lower extremity thereof, and a pivoting means extending through the pivot pin openings for holding the jaws together in pivotal interrelationship, the first jaw having an outward projecting lower extremity and having a first vertical bore in the extremity for receiving a threaded screw, the second jaw having an outer extremity with a second vertical threaded bore, the second vertical threaded bore being aligned parallel to the first vertical threaded bore and being displaced outwardly therefrom, a threaded forcer screw engaged in threads of the second bore and extending downward therefrom and a breaker tip insert in a lower end of the forcer screw, the first jaw having an upward facing surface above the first bore, an anvil plate positioned on the upward facing surface, and extending outward therefrom below the breaker tip, the first and second pivot pin receiving openings being positioned over the anvil plate, wherein the second jaw has a retaining portion extending between the second opening and the outward extending portion with a bore for receiving the forcer screw, wherein the retaining portion overlies the anvil plate and retains the anvil plate against accidental dislodgement.

2. The apparatus of claim 1 wherein the anvil plate is an anvil plate turret, turnable about the threaded insert and wherein a portion of the jaw having the first pivot pin receiving opening extends over the anvil turret for retaining the anvil turret.

3. The apparatus of claim 1 wherein the retaining portion overlies the threaded insert for retaining the threaded insert and the anvil plate against accidental dislodging.

4. The apparatus of claim 3 wherein the retaining portion has an outer surface spaced slightly inward from the forcer screw and the breaker tip whereby the outer surface of the retaining portion prevents movement of workpiece parts in a direction toward the pivot pin and toward a person using the tool.

5. The apparatus of claim 4 wherein the outer surface is generally flat.

6. The apparatus of claim 1 wherein the threaded insert extends above the anvil plate, whereby when the jaws are opened, the threaded insert may be turned out of the first bore, releasing the anvil plate for replacement by a different anvil plate.

7. The apparatus of claim 6 wherein the anvil plate has a plurality of holes and further comprising a plunger bore mounted in the lower jaw parallel to and inward of the first bore and a plunger pin mounted in the plunger bore for contacting recesses in the anvil plate to firmly position the anvil plate on the upper surface of the first jaw.

8. The apparatus of claim 1 further comprising first and second handle connecting means mounted at distal ends of the first and second jaws remote from the first and second bores.

9. The apparatus of claim 8 wherein the handle connection means are substantially equidistant from the first pivot pin receiving openings.

10. The apparatus of claim 9 further comprising first and second handles having first and second proximal ends connected to the first and second connection means for pivoting therewith, the first and second handles having inward extensions near proximal ends thereof and having first and second openings for receiving a handle pivot pin, and a handle pivot pin inserted in the first and second openings and wherein the handle and the pivot pin in the jaws are generally aligned on a first line and wherein the first and second connection means are generally aligned on a second line perpendicularly intersecting the first line near the handle pin.

11. The apparatus of claim 10 wherein the second line intersects the first line at about 8 to 10 percent of the distance between the handle pin and the jaw pivot pin along the first line.

12. The apparatus of claim 11 wherein the forcer screw and the breaker tip are aligned perpendicular to an extension of the first line.

13. The apparatus of claim 12 wherein the forcer screw and breaker tip are positioned approximately half as far from the jaw pivot pin as the distance between the jaw pivot pin and the handle pin.

14. The apparatus of claim 1 wherein an upper portion of the first jaw is centrally slotted and wherein a lower portion of the second jaw is reduced in size compared with an upper portion of the second jaw whereby the lower portion of the second jaw fits within the central upper slot of the first jaw.

* * * * *